US012247358B2

(12) United States Patent
Ueda et al.

(10) Patent No.: US 12,247,358 B2
(45) Date of Patent: Mar. 11, 2025

(54) RAIL

(71) Applicant: NIPPON STEEL CORPORATION, Tokyo (JP)

(72) Inventors: Masaharu Ueda, Tokyo (JP); Teruhisa Miyazaki, Tokyo (JP); Takuya Tanahashi, Tokyo (JP); Yusuke Maeda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 872 days.

(21) Appl. No.: 17/432,607

(22) PCT Filed: Mar. 2, 2020

(86) PCT No.: PCT/JP2020/008606
§ 371 (c)(1),
(2) Date: Aug. 20, 2021

(87) PCT Pub. No.: WO2020/189232
PCT Pub. Date: Sep. 24, 2020

(65) Prior Publication Data

US 2022/0120039 A1 Apr. 21, 2022

(30) Foreign Application Priority Data

Mar. 15, 2019 (JP) ..... 2019-048809

(51) Int. Cl.
*E01B 5/08* (2006.01)
*C21D 6/00* (2006.01)
(Continued)

(52) U.S. Cl.
CPC ..... *E01B 5/08* (2013.01); *C21D 6/001* (2013.01); *C21D 6/002* (2013.01); *C21D 6/005* (2013.01);
(Continued)

(58) Field of Classification Search
CPC .... E01B 5/02; E01B 5/08; C21D 9/04; C21D 2211/009
(Continued)

(56) References Cited

U.S. PATENT DOCUMENTS 5,714,020 A 2/1998 Perrin
5,762,723 A 6/1998 Ueda et al.
(Continued)

FOREIGN PATENT DOCUMENTS

CN 1793403 A 6/2006
CN 107208216 A 9/2017
(Continued)

OTHER PUBLICATIONS

GOST R 51685-2013, Railway rails, M., Standartinform, 2014.
(Continued)

*Primary Examiner* — Zachary L Kuhfuss
(74) *Attorney, Agent, or Firm* — Rabin & Berdo, P.C.

(57) ABSTRACT

A rail including a predetermined chemical composition is provided, in which 90 area % or greater of a metallographic structure in a cross section of a rail web portion is a pearlite structure, a minimum value of a hardness in the cross section of the rail web portion is Hv 300 or greater, and a difference between a maximum value and the minimum value of the hardness in the cross section of the rail web portion is Hv 40 or less.

5 Claims, 3 Drawing Sheets

(51) Int. Cl.

| | |
|---|---|
| ***C21D 8/00*** | (2006.01) |
| ***C21D 9/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |

(52) U.S. Cl.
CPC ..... *C21D 6/007* (2013.01); *C21D 6/008* (2013.01); *C21D 8/005* (2013.01); *C21D 9/04* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/18* (2013.01); *C21D 2211/009* (2013.01)

(58) Field of Classification Search
USPC ..... 148/581; 238/150
See application file for complete search history.

(56) References Cited

U.S. PATENT DOCUMENTS

| | | | | |
|---|---|---|---|---|
| 7,972,451 | B2 * | 7/2011 | Ueda | C22C 38/002 148/333 |
| 10,047,411 | B2 * | 8/2018 | Ueda | C21D 9/04 |
| 2001/0025674 | A1 | 10/2001 | Prskawetz et al. | |
| 2004/0187981 | A1 | 9/2004 | Ueda et al. | |
| 2008/0011393 | A1 * | 1/2008 | Ueda | C22C 38/18 148/584 |
| 2012/0015212 | A1 | 1/2012 | Karimine et al. | |
| 2017/0369961 | A1 | 12/2017 | Ueda et al. | |

FOREIGN PATENT DOCUMENTS

| | | | |
|---|---|---|---|
| GB | 1370144 | A | 10/1974 |
| JP | S63-23244 | B2 | 5/1988 |
| JP | S63128123 | A | 5/1988 |
| JP | H08-144016 | A | 6/1996 |
| JP | H08-170120 | A | 7/1996 |
| JP | H08-246100 | A | 9/1996 |
| JP | H09137228 | A | 5/1997 |
| JP | H10195601 | A | 7/1998 |
| JP | 2002-226915 | A | 8/2002 |
| JP | 2004-043863 | A | 2/2004 |
| JP | 2005171327 | A | 6/2005 |
| JP | 2009263753 | A | 11/2009 |
| JP | 4819183 | B2 | 11/2011 |
| RU | 94019951 | A | 4/1996 |
| RU | 2280700 | C1 | 7/2006 |
| RU | 2283353 | C1 | 9/2006 |

OTHER PUBLICATIONS

GOST R51045-97, Railway rails of types RP50, RP65 and RP75 for industrial railway transport, M., Gosstandart Russia, 1997.

Russian Office Action dated Mar. 21, 2022 in the counterpart Russian Application No. 2021126575.

* cited by examiner

RAIL

TECHNICAL FIELD OF THE INVENTION

The present invention relates to a rail which is used in freight railways and has excellent damage resistance.

Priority is claimed on Japanese Patent Application No. 2019-048809, filed Mar. 15, 2019, the content of which is incorporated herein by reference.

RELATED ART

With economic development, natural resources such as coal have been newly developed. Specifically, mining of natural resources has been promoted in underdeveloped regions with severe natural environments. Along with this, the environment around a railway track for freight railways used to transport resources has become significantly severe. For this reason, rails have been required to have more wear resistance than ever. From this background, there has been a demand for development of rails with improved wear resistance.

In addition, in recent years railway transport has become further overcrowded, and fatigue damage may occur from a rail web portion. For this reason, in order to further improve the rail service life, in the rail, there has been a demand for an improvement in fatigue damage resistance of a web portion in addition to an improvement in wear resistance of a head portion. Such a demand is particularly significant in a rail used in a curved track. In a curved track, it is clear from recent investigation that since stress toward the outside of the curve is applied to a rail head portion causing bending stress to be applied to the rail web portion, fatigue damage is likely to occur from the web portion as a starting point.

In order to improve the wear resistance of rail steel, for example, high-strength rails shown in Patent Documents 1 and 2 have been developed. The main features of these rails include, in order to improve the wear resistance, increasing the hardness of steel by refinement of lamellar spacing of pearlite of a rail head portion using a heat treatment, or increasing the volume fraction of cementite in a lamella of the pearlite of the rail head portion by increasing the amount of carbon in steel.

Patent Document 1 discloses that a rail having excellent wear resistance can be obtained by performing accelerated cooling on a rail head portion which is rolled or re-heated at a cooling rate of 1 to 4° C./sec from the austenite temperature range to a range of 850 to 500° C.

In addition, Patent Document 2 discloses that a rail having excellent wear resistance can be obtained by increasing the volume fraction of cementite in a lamella in a pearlite structure of a rail head portion using hyper-eutectoid steel (C: greater than 0.85% and 1.20% or less)

In the technique disclosed in Patent Document 1 or 2, due to an increase in hardness by refining lamellar spacing in the pearlite structure of the rail head portion or an increase in volume fraction of cementite in the lamella in the pearlite structure, the wear resistance of the rail head portion is improved, and the service life is improved to a certain extent. However, in the rails disclosed in Patent Documents 1 and 2, no research has been made on fatigue damage resistance that prevents fatigue damage to a rail web portion.

In addition, for example, Patent Document 3 discloses that a rail having improved toughness of a rail web portion can be obtained by controlling the amount of formation of a pro-eutectoid cementite structure in the rail web portion.

In the technique disclosed in Patent Document 3, the amount of formation of a cementite structure in a pearlite structure is controlled to improve the toughness of the rail web portion, suppress breakage to the rail, and improve the service life to a certain extent. However, in the rail disclosed in Patent Document 3, no research has been made on fatigue damage resistance that prevents fatigue damage to the rail web portion.

In addition, for example, Patent Document 4 discloses that a rail having improved fatigue properties of a rail web portion can be obtained by reducing residual stress by cooling of a rail welded joint portion immediately after welding.

In the technique disclosed in Patent Document 4, the residual stress of the rail welded joint portion is controlled to improve the fatigue properties of the rail web portion, suppress breakage to the rail, and improve the service life to a certain extent. However, in the rail disclosed in Patent Document 4, the rail welded joint is a target, and no research has been made on the prevention of fatigue damage to a rail base material. In addition, in the technique disclosed in Patent Document 4, the residual stress is controlled, and no research has been made on a relationship between the material and the hardness and the fatigue properties of the rail web portion in Patent Document 4.

In addition, in a technique disclosed in Patent Document 5, in a heat treatment method of a rail, the hardness of a rail web portion required to ensure toughness is defined. However, in the rail disclosed in Patent Document 5, no research has been made on the prevention of fatigue damage to a rail web portion. In addition, in Patent Document 5, only the range of the average value of the hardness of the web portion is illustrated, and no research has been made on a hardness distribution that affects suppression of fatigue damage to the rail web portion.

PRIOR ART DOCUMENT

Patent Document

[Patent Document 1] Japanese Examined Patent Application, Second Publication No. S63-023244

[Patent Document 2] Japanese Unexamined Patent Application, First Publication No. H8-144016

[Patent Document 3] Japanese Unexamined Patent Application, First Publication No. 2004-43863

[Patent Document 4] Japanese Patent No. 4819183

[Patent Document 5] Japanese Unexamined Patent Application, First Publication No. H8-170120

[Patent Document 6] Japanese Unexamined Patent Application, First Publication No. 2002-226915

[Patent Document 7] Japanese Unexamined Patent Application, First Publication No. H8-246100

DISCLOSURE OF THE INVENTION

Problems to be Solved by the Invention

The present invention has been made in view of the above problems. An object of the present invention is to provide a rail that can suppress fatigue damage from occurring from a web portion and has excellent fatigue breakage resistance, which is required for a rail of a freight railway. Particularly, an object of the present invention is to provide a rail that can suppress the occurrence of fatigue damage even when the rail is applied to a curved track in which fatigue breakage is likely to occur.

Means for Solving the Problem

The concept of the present invention is as follows.

(1) A rail according to one aspect of the present invention has steel composition including, by mass %: C: 0.75 to 1.20%; Si: 0.10 to 2.00%; Mn: 0.10 to 2.00%; Cr: 0 to 2.00%; Mo: 0 to 0.50%; Co: 0 to 1.00%, B: 0 to 0.0050%; Cu: 0 to 1.00%; Ni: 0 to 1.00%; V: 0 to 0.50%; Nb: 0 to 0.050%, Ti: 0 to 0.0500%; Mg: 0 to 0.0200%; Ca: 0 to 0.0200%; REM: 0 to 0.0500%; Zr: 0 to 0.0200%; N: 0 to 0.0200%; Al: 0 to 1.00%; P: 0.0250% or less; S: 0.0250% or less; and a remainder consisting of Fe and impurities, in which 90 area % or greater of a metallographic structure in a cross section of a rail web portion is a pearlite structure, a minimum value of a hardness in the cross section of the rail web portion is Hv 300 or greater, and a difference between a maximum value and the minimum value of the hardness in the cross section of the rail web portion is Hv 40 or less.

(2) In the rail described in (1), the difference between the maximum value and the minimum value of the hardness in the cross section of the rail web portion may be Hv 20 or less.

(3) In the rail described in (1) or (2), the steel composition may include, by mass %, one or two or more selected from the group consisting of: Cr: 0.01 to 2.00%; Mo: 0.01 to 0.50%; Co: 0.01 to 1.00%; B: 0.0001 to 0.0050%; Cu: 0.01 to 1.00%; Ni: 0.01 to 1.00%; V: 0.005 to 0.50%; Nb: 0.0010 to 0.050%; Ti: 0.0030 to 0.0500%; Mg: 0.0005 to 0.0200%; Ca: 0.0005 to 0.0200%; REM: 0.0005 to 0.0500%; Zr: 0.0001 to 0.0200%; N: 0.0060 to 0.0200%; and Al: 0.0100 to 1.00%.

Effects of the Invention

According to the aspect of the present invention, a rail can be provided which has excellent fatigue damage resistance required for a web portion of a rail applied to a curved track of a freight railway.

EMBODIMENTS OF THE INVENTION

Hereinafter, a rail having excellent fatigue damage resistance in a web portion according to an embodiment of the present invention (also referred to as a rail according to the present embodiment) will be described in detail. Hereinafter, % in the composition is mass %.

First, the present inventors investigated in more detail the cause of fatigue damage occurring from a rail web portion in current freight railways. As a result of detailed investigation of the rail including a pearlite structure in which fatigue damage occurred, it was found that there was a correlation between the cross-sectional hardness of the web portion and the fatigue damage of the rail. In the rail in which a region where the hardness in a cross section of the rail web portion was less than Hv 300 was present, it was confirmed that fatigue damage occurred from the rail web portion.

Further, the present inventors investigated in more detail the rail in which the fatigue damage occurred. As a result, a case was confirmed in which in a curved track exposed to a severe use environment, even in a rail in which a region where the hardness in a cross section of a rail web portion was less than Hv 300 was not present, fatigue damage occurred from the web portion.

Therefore, the present inventors performed a prototype evaluation on the actual rail to investigate in more detail the cause of fatigue damage occurring from the web portion even in the rail in which the region where the hardness in the cross section of the rail web portion was less than Hv 300 was not present.

Figure 4:
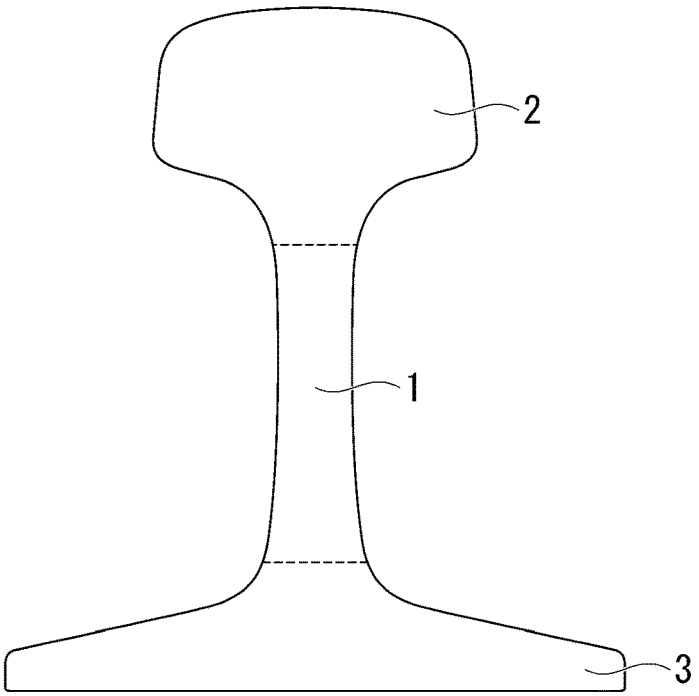
FIG. 4 is a schematic view of a cross section of the rail according to the present embodiment.

Here, the present inventors performed a fatigue damage test for simulating a curved track in the prototype evaluation. The reason is that there are unique circumstances where bending stress is likely to be applied to the web portion in the curved track. As shown in FIG. 4, the rail includes a rail web portion 1, a rail head portion 2, and a rail foot portion 3. Since the rail web portion 1 was not in contact with wheels, the rail web portion 1 was not necessarily regarded as being important in the related art. However, in the curved track, during passing of a train, stress toward the outside of the curved track is applied to the rail head portion 2, so that bending stress is applied to the rail web portion 1. The present inventors presumed that fatigue damage was likely to occur in the rail web portion 1 in the curved track due to the repeated generation of such bending stress, and thought that the fatigue damage test should also be carried out to reproduce the above-described bending stress. The details of a prototype evaluation technique will be shown below.

Rail hot rolling and a heat treatment were performed on steel (hyper-eutectoid steel) including the following steel composition under various conditions to produce prototype rails having various cross-sectional hardnesses in rail web portions, and the prototype rails were evaluated for fatigue damage resistance. Then, the relationship between the cross-sectional hardness of the rail web portion and the fatigue damage resistance was investigated. Rail hot rolling conditions, heat treatment conditions, and fatigue test conditions are as shown below. Incidentally, in order to change the cross-sectional hardness of the rail web portion, controlled cooling was carried out on the web portion.

[Actual Rail Hot Rolling and Heat Treatment Conditions]

Steel Component 0.90% C-0.50% Si-0.70% Mn-0.0150% P-0.0120% S (remainder consisting of Fe and impurities)

Rail Shape 141 lbs (weight. 70 kg/m).

Hot Rolling and Heat Treatment Conditions

Final rolling temperature (outer surface of web portion): 900° C.

Heat treatment conditions: hot rolling→accelerated cooling

Controlled cooling conditions (outer surface of web portion): accelerated cooling in the temperature range from 800° C. to 500° C. was performed at an average cooling rate of 0.5 to 5° C./sec, or accelerated cooling from 800° C. to 580 to 680° C. was performed. Thereafter, after a temperature rise by the generation of reheat and the temperature retention occurred, accelerated cooling was carried out again.

Incidentally, the accelerated cooling was carried out by injecting a cooling medium such as air or cooling water onto either of the surface of the rail head portion and the surface of the web portion or both the surfaces. In addition, the temperature rise by the generation of reheat and the temperature retention were controlled by repeating slight accelerated cooling depending on the amount of the temperature rise.

[Method for Measuring Cross-Sectional Hardness of Rail Web Portion, Measurement Conditions, and Method for Organizing Hardness]

Measurement Device and Method

- Device: Vickers hardness meter (load of 98 N)
- Collection of test piece for measurement: a sample was cut out from a cross section of the rail web portion
- Pre-processing: the cross section was polished with a diamond grit having an average grain size of 1 μm
- Measurement method: the hardness was measured according to JIS Z 2244: 2009

Measurement Position

Figure 1:
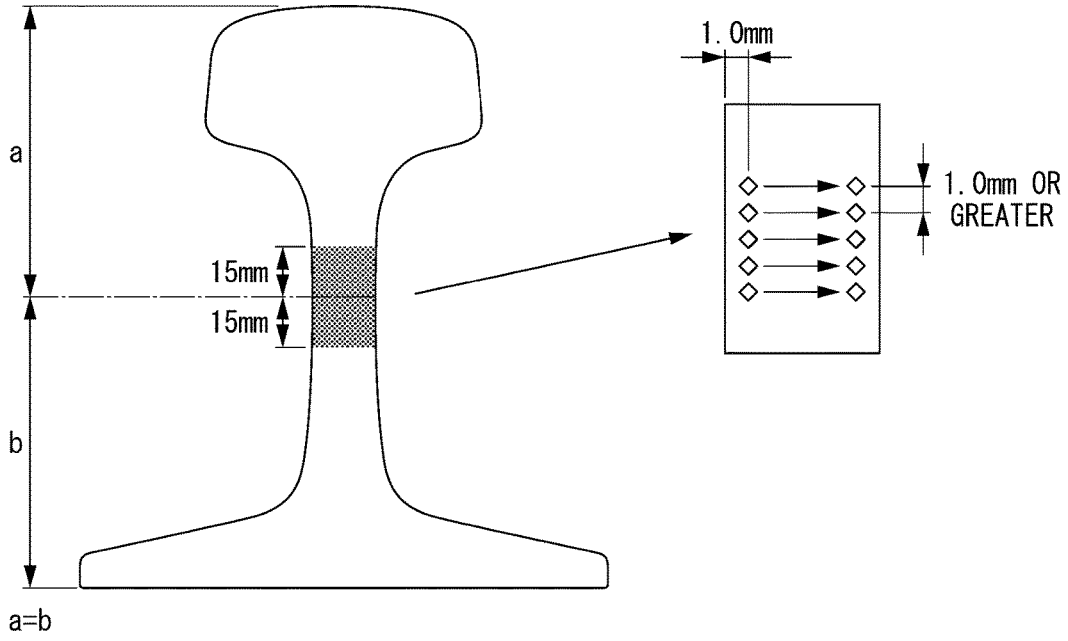
FIG. 1 is a view showing the measurement position of the hardness in a cross section of a rail web portion.

The measurement position was in a cross section in a range of ±15 mm in an upward and downward direction of the rail from a middle line between a rail bottom portion and a rail top portion (refer to FIG. 1).

Indentations were continuously made in a thickness direction of the web portion in a row at a pitch of 1.0 mm in which the starting point of the continuous indentation is the position of a depth of 1.0 mm from the outer surface of the web portion, and the hardness distribution was measured. The measurement of the hardness was performed on at least five lines.

Incidentally, in order to eliminate the mutual influences of the indentations, an interval of 1.0 mm or greater was provided between the measurement lines.

Method for Organizing Hardness

The minimum value and the maximum value of the measured hardness were defined as the minimum value and the maximum value of the cross-sectional hardness of each of the rail web portions.

[Hardness Characteristics of Test Rail]

- Range of minimum value of cross-sectional hardness of rail web portion: Hv 300 to 500
- Difference between minimum value and maximum value of cross-sectional hardness of rail web portion: Hv 10 to 80

[Fatigue Test Method and Test Conditions for Rail Web Portion]

Fatigue Test of Rail

Figure 2:
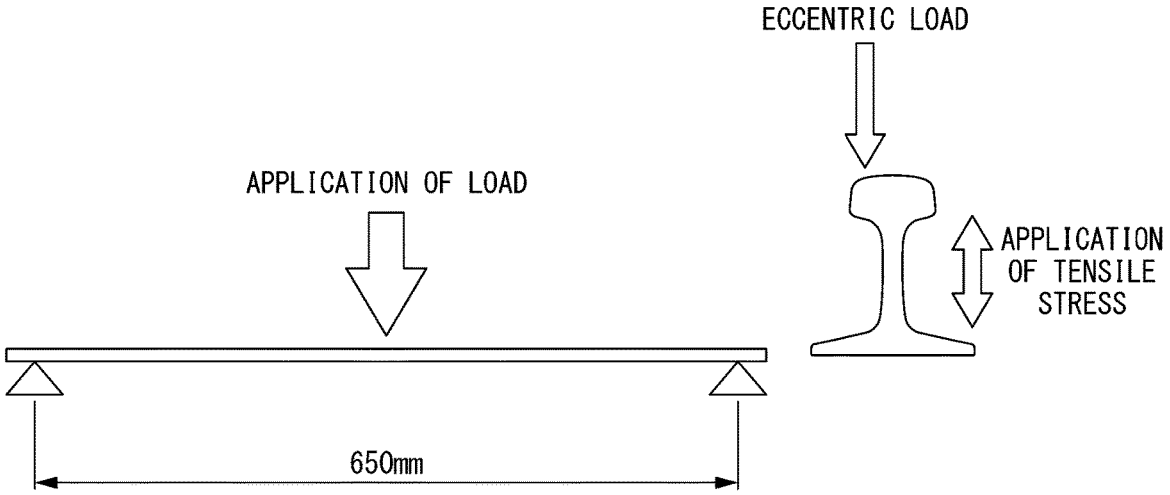
FIG. 2 is a view showing the outline of a fatigue test of a rail.

- Test method: bending of the actual rail at three points (span length: 650 mm and refer to FIG. 2)
- Load conditions: fluctuation in a range of 2 to 20 tons.
- Frequency of fluctuation in applied load: 5 Hz
- Test posture: an eccentric load was applied to the rail head portion. The position of application of the load was set to a position shifted by one third of the width of the rail head portion from the center of the rail head portion in a width direction of the rail (refer to FIG. 2).
- Measurement of stress: the stress was measured with a strain gauge attached to the rail web portion
- Number of repetitions of load fluctuation: up to 3 million repetitions at the maximum (without initiation of a crack) or until the initiation of a crack.
- Determination of crack: the test was periodically stopped, and a magnetic particle inspection was performed on the surface of the rail web portion to confirm whether or not a crack was present in the surface of the rail web portion
- Determination of pass: the rail in which the number of repetitions of load fluctuation until the initiation of a crack was 2 million or greater or a crack did not initiate until the end of the test (load fluctuated 3 million repetitions) was determined as a rail having excellent fatigue breakage resistance As shown in FIG. 2, when an eccentric load fluctuating at regular intervals was applied to the rail, bending stress was applied to the rail web portion at regular intervals. Accordingly, it was possible to simulate the bending stress (tensile stress in the upward and downward direction applied to a side of the rail web portion, the side corresponding to an outer side of the curve) applied to the rail web portion due to the centrifugal force of the train passing through the curved track.

As a result of investigating in detail the web portion of the rail in which a crack initiated before the number of repetitions of load fluctuation reached 2 million, it was confirmed that a crack initiated in the rail in which the hardness in the cross section was significantly nonuniform (namely, the difference between the maximum value and the minimum value of the cross-sectional hardness was large). The present inventors found from the result that the initiation of a crack resulted from strain being concentrated in the cross section of the web portion due to the cross-sectional hardness significantly being nonuniform.

Figure 3:
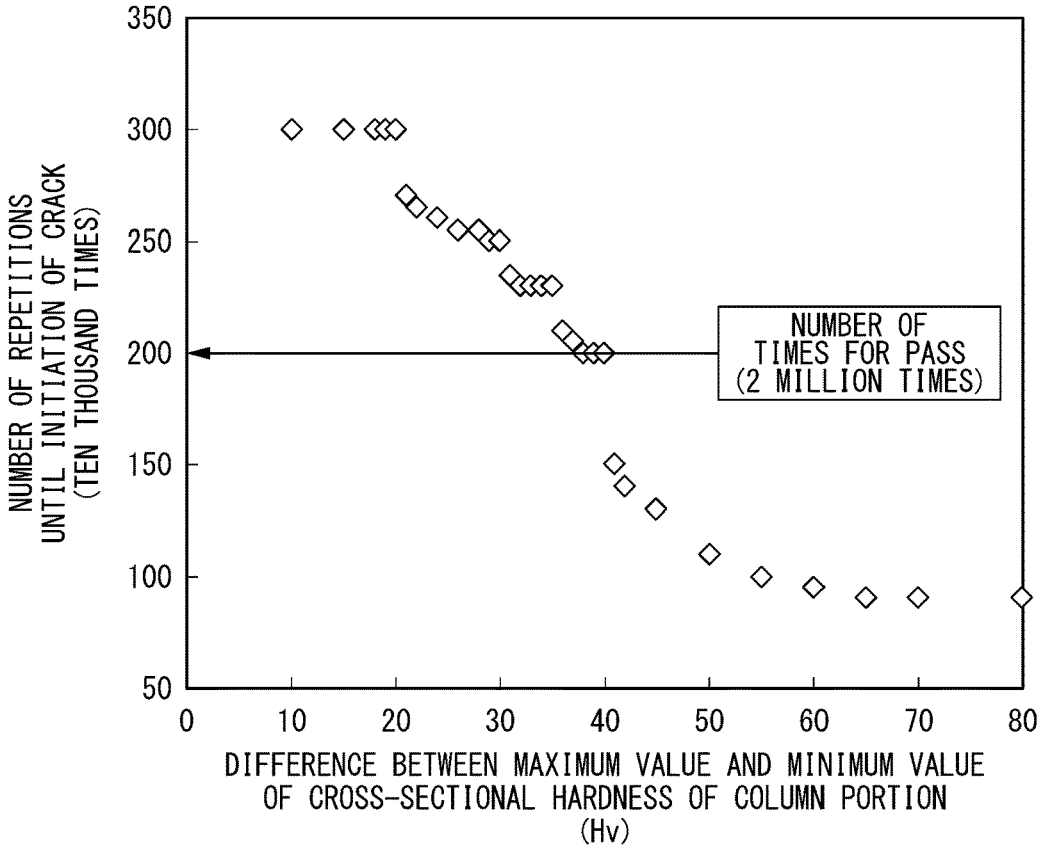
FIG. 3 is a graph showing the relationship between a difference between the maximum value and the minimum value of the hardness in the cross section of the rail web portion and the number of repetitions at the time of initiation of a crack in the fatigue test of the rail.

FIG. 3 shows the results of the fatigue tests of the rails. FIG. 3 shows the relationship between a difference between the maximum value and the minimum value of the cross-sectional hardness of the rail web portion and the number of repetitions of load fluctuation until the initiation of a crack in the fatigue test. As can be seen from the results of FIG. 3, there is a correlation between the difference between the maximum value and the minimum value of the cross-sectional hardness and the number of repetitions of load fluctuation until the initiation of a crack in the fatigue test, and when the difference between the maximum value and the minimum value of the cross-sectional hardness decreases, the number of repetitions of load fluctuation until the initiation of a crack tends to increase. Particularly, the present inventors confirmed that when the difference between the maximum value and the minimum value of the cross-sectional hardness was Hv 40 or less, a crack did not initiate until the number of repetitions of load fluctuation reached 2 million, and the damage resistance of the web portion was significantly improved.

Further, the present inventors confirmed that when the difference between the maximum value and the minimum value of the cross-sectional hardness of the web portion was Hv 20 or less, the number of repetitions of load fluctuation until the initiation of a crack further increased, and a crack did not initiate up to 3 million repetitions, and the damage resistance of the web portion was further improved.

It is said that an increase in hardness (full hardening) of a material is effective in preventing fatigue fracture of the material. However, the present inventors newly found that in order to suppress the initiation of fatigue damage in the rail web portion, in addition to an increase in hardness of the rail web portion, it was necessary to suppress the difference between the maximum value and the minimum value of the hardness in the cross section of the rail web portion, and suppress the strain concentration in the cross section of the rail web portion.

FIG. 4 is a schematic view of a cross section of the rail according to the present embodiment. The web portion of the rail (rail web portion 1) according to the present embodiment will be described again with reference to FIG. 4.

When a cross section vertical to a length direction of the rail is viewed, a portion of the rail which is constricted in width is present at the center in a height direction of the rail. The constricted portion is referred to as the rail web portion 1. A portion which has a width larger than the width of the constricted portion and is located below the constricted portion is referred to as the rail foot portion 3, and a portion located above the constricted portion is referred to as the rail head portion 2. The rail web portion 1 is a region interposed between the rail head portion 2 and the rail foot portion 3.

(1) Reason for Limiting Chemical Composition (Steel Component) of Rail Steel

The reason for limiting the chemical composition (steel composition) of the steel in the rail according to the present embodiment will be described in detail.

C: 0.75 to 1.20%

C is an element that promotes pearlitic transformation and contributes to an improvement in fatigue resistance. However, when the C content is less than 0.75%, the lower limit of the strength or the fatigue damage resistance required for the rail cannot be ensured. Further, when the C content is less than 0.75%, a soft pro-eutectoid ferrite structure is likely to be formed in the rail web portion, the hardness difference in the cross section of the rail web portion increases, and the fatigue damage resistance deteriorates. On the other hand, when the C content exceeds 1.20%, a hard pro-eutectoid cementite structure is likely to be formed in the rail web portion, the hardness difference in the cross section of the rail web portion increases, and the fatigue damage resistance deteriorates. Therefore, in order to promote the formation of a pearlite structure and ensure the fatigue damage resistance, the C content is set to 0.75 to 1.20%. In order to further stabilize the formation of the pearlite structure and further improve the fatigue damage resistance, it is desirable that the C content be set to 0.80% or greater, 0.85% or greater, or 0.90% or greater. In addition, for the same reason, it is desirable that the C content be set to 1.15% or less, 110% or less, or 1.05% or less.

Si 0.10 to 2.00%

Si is an element that is solid-solubilized in ferrite of the pearlite structure, increases the cross-sectional hardness (strength) of the rail web portion, and improves the fatigue damage resistance. Further, Si is also an element that suppresses the formation of the pro-eutectoid cementite structure, suppresses the hardness difference in the cross section of the rail web portion, and improves the fatigue damage resistance. However, when the Si content is less than 0.10%, the effects cannot be sufficiently obtained. On the other hand, when the Si content exceeds 2.00%, many surface defects initiate during hot rolling. Further, when the Si content exceeds 2.00%, hardenability significantly increases, a hard martensite structure is likely to be formed in the rail web portion, the hardness difference in the cross section of the rail web portion increases, and the fatigue damage resistance deteriorates. Therefore, in order to promote the formation of the pearlite structure and ensure the fatigue damage resistance or toughness, the Si content is set to 0.10 to 2.00% In order to further stabilize the formation of the pearlite structure and further improve the fatigue damage resistance or toughness, it is desirable that the Si content be set to 0.15% or greater, 0.20% or greater, or 0.40% or greater. For the same reason, it is desirable that the Si content be set to 1.80% or less, 1.50% or less, or 1.30% or less.

Mn: 0.10 to 2.00%

Mn is an element that increases the hardenability, suppresses the formation of the soft pro-eutectoid ferrite structure, and stabilizes pearlitic transformation, and at the same time, refines the lamellar spacing of the pearlite structure and ensures the hardness of the pearlite structure, and thus improves the fatigue damage resistance. However, when the Mn content is less than 0.10%, the effect decreases, the soft pro-eutectoid ferrite structure is likely to be formed in the rail web portion, the hardness difference in the cross section of the rail web portion increases, and the fatigue damage resistance deteriorates. On the other hand, when the Mn content exceeds 2.00%, the hardenability significantly increases, the hard martensite structure is likely to be formed in the rail web portion, the hardness difference in the cross section of the rail web portion increases, and the fatigue damage resistance deteriorates. Therefore, in order to promote the formation of the pearlite structure and ensure the fatigue damage resistance or the toughness, the Mn content is set to 0.10 to 2.00%. In order to stabilize the formation of the pearlite structure and further improve the fatigue damage resistance or the toughness, it is desirable that the Mn content be set to 0.20% or greater, 0.30% or greater, or 0.40% or greater. For the same reason, it is desirable that the Mn content be set to 1.80% or less, 1.50% or less, or 1.20% or less.

P: 0.0250% or Less

P is an impurity element included in the steel. The content can be controlled by performing refining in a converter. It is preferable that the P content be small, but particularly when the P content exceeds 0.0250%, the concentration of P in a segregation zone of the rail web portion is promoted, the hardness of a segregation portion increases, the hardness difference in the cross section of the rail web portion increases, and the fatigue damage resistance deteriorates. For this reason, the P content is limited to 0.0250% or less. Incidentally, in order to stably ensure the fatigue damage resistance of the rail web portion, it is desirable that the P content be set to 0.0200% or less, 0.0180% or less, or 0.0150% or less. Since P does not contribute to solving the problem of the invention, it is not necessary to limit the lower limit of the P content, and the lower limit may be set to, for example, 0%. However, in consideration of dephosphorization capacity in the refining process, it is economically advantageous to set the lower limit of the P content to approximately 0.0050%.

S: 0.0250% or Less

S is an impurity element included in the steel. The content can be controlled by performing desulfurization in a melting furnace. It is preferable that the S content be small, but particularly when the S content exceeds 0.0250%, the formation of a MnS-based sulfide is promoted, and the concentration of Mn in the steel decreases. As a result, a negative segregation portion is formed, the hardness of the negative segregation portion decreases, the hardness difference in the cross section of the rail web portion increases, and the fatigue damage resistance deteriorates. For this reason, the S content is limited to 0.0250% or less. Incidentally, in order to more stably ensure the fatigue damage resistance of the rail web portion, it is desirable that the S content be set to 0.0200% or less, 0.0180% or less, or 0.0150% or less. Since S does not contribute to solving the problem of the invention, it is not necessary to limit the lower limit of the S content, and the lower limit may be set to, for example, 0%. However, in consideration of desulfurization capacity in the refining process, it is economically advantageous to set the lower limit of the S content to approximately 0.0030%.

Basically, the rail according to the present embodiment includes the above chemical composition and a remainder including Fe and impurities. However, instead of a part of Fe of the remainder, if necessary, in order to further improve the fatigue damage resistance by increasing the hardness (strength) of the pearlite structure, particularly, control the cross-sectional hardness distribution of the rail web portion, one or two or more selected from the group consisting of Cr, Mo, Co, B, Cu, Ni, V, Nb, Ti, Mg, Ca, REM, Zr, N, and Al may be included in the ranges to be described later. Specifically, Cr and Mo refine the lamellar spacing to improve the hardness of the pearlite structure. Co refines a lamellar structure to increase the hardness of the pearlite structure. B reduces the cooling rate dependence of a pearlitic transformation temperature to uniformize the hardness distribution in the cross section of the rail web portion. Cu is solid-solubilized in ferrite of the pearlite structure to increase the hardness of the pearlite structure Ni is solid-solubilized in ferrite of the pearlite structure to improve the hardness of the pearlite structure. V, Nb, and Ti improve the hardness of the pearlite structure by precipitation hardening of a carbide or a nitride formed during hot rolling or in the process of cooling after hot rolling. Mg, Ca, and REM finely disperse the MnS-based sulfide to promote pearlitic transformation. Zr increases the equiaxed crystal ratio of a solidification structure to suppress the formation of a segregation zone in a bloom or slab center portion, suppress the formation of the pro-eutectoid ferrite structure or a pro-eutectoid cementite structure, and promote pearlitic transformation. N segregates an austenite grain boundary to promote pearlitic transformation. Al shifts a eutectoid transformation temperature to a high-temperature side to improve the hardness of the pearlite structure. For this reason, in order to obtain the above effects, these elements may be included in the ranges to be described later. Incidentally, even when these elements are included in the ranges to be described later, these elements do not impair the characteristics of the rail according to the present embodiment. In addition, since these elements should not be necessarily included, the lower limit thereof is set to 0%.

Cr: 0 to 2.00%

Cr raises an equilibrium transformation temperature, and increases the degree of supercooling, and thus refines the lamellar spacing of the pearlite structure, and improves the hardness (strength) of the pearlite structure. In addition, Cr is an element that increases the hardenability, suppresses the formation of the soft pro-eutectoid ferrite structure, stabilizes pearlitic transformation, and improves the fatigue damage resistance. In order to obtain the effects, it is preferable that the Cr content be set to 0.01% or greater, 0.02% or greater, or 0.10% or greater. On the other hand, when the Cr content exceeds 2.00%, the hardenability significantly may increase, the hard martensite structure may be likely to be formed in the rail web portion, the hardness difference in the cross section of the rail web portion may increase, and the fatigue damage resistance may deteriorate. For this reason, it is preferable that the Cr content be set to 2.00% or less, 1.80% or less, or 1.50% or less when Cr is included.

Mo: 0 to 0.50%

Similar to Cr, Mo raises the equilibrium transformation temperature, and increases the degree of supercooling, and thus refines the lamellar spacing of the pearlite structure, and improves the hardness (strength) of the pearlite structure. Particularly, Mo is an element that increases the hardness of the soft pearlite structure of the rail web portion, reduces the hardness difference in the pearlite structure, and improves the fatigue damage resistance of the rail web portion. In order to obtain the effects, it is preferable that the Mo content be set to 0.01% or greater, 0.02% or greater, or 0.10% or greater. On the other hand, when the Mo content exceeds 0.50%, the transformation rate significantly decreases, the hard martensite structure may be likely to be formed in the rail web portion, the hardness difference in the cross section of the rail web portion may increase, and the fatigue damage resistance may deteriorate. For this reason, it is preferable that the Mo content be set to 0.50% or less, 0.40% or less, or 0.30% or less when Mo is included.

Co: 0 to 1.00%

Co refines the lamellar structure in the pearlite structure to improve the hardness (strength) of the pearlite structure. Particularly, Co is an element that increases the hardness of the soft pearlite structure of the rail web portion, reduces the hardness difference in the pearlite structure, and improves the fatigue damage resistance of the rail web portion. In order to obtain the effects, it is preferable that the Co content be set to 0.01% or greater, 0.02% or greater, or 0.10% or greater. On the other hand, when the Co content exceeds 1.00%, the above effect is saturated, and economic efficiency may deteriorate due to an increase in cost of adding alloys. For this reason, it is preferable that the Co content be set to 1.00% or less, 0.80% or less, or 0.50% or less when Co is included.

B: 0 to 0.0050%

B is an element that causes an iron-boron carbide ($Fe_{23}(CB)_6$) to be formed in an austenite grain boundary, and promotes pearlitic transformation, and thus reduces the cooling rate dependence of the pearlitic transformation temperature. When the cooling rate dependence of the pearlitic transformation temperature is reduced, the hardness distribution in the cross section of the rail web portion is uniformized, and the fatigue damage resistance is improved. In order to obtain the effects, it is preferable that the B content be set to 0.0001% or greater, 0.0005% or greater, or 0.0010% or greater. On the other hand, when the B content exceeds 0.0050%, a coarse iron-boron carbide may be formed, and fatigue damage may be likely to occur in the rail web portion due to stress concentration. For this reason, it is preferable that the B content be set to 0.0050% or less, 0.0040% or less, or 0.0030% or less when B is included.

Cu: 0 to 1.00%

Cu is solid-solubilized in ferrite of the pearlite structure to improve the hardness (strength) by solid solution strengthening. Particularly, Cu is an element that increases the hardness of the soft pearlite structure of the rail web portion, reduces the hardness difference in the pearlite structure, and improves the fatigue damage resistance of the rail web portion. In order to obtain the effects, it is preferable that the Cu content be set to 0.01% or greater, 0.02% or greater, or 0.10% or greater. On the other hand, when the Cu content exceeds 1.00%, due to a significant improvement in hardenability, the hard martensite structure may be likely to be formed in the rail web portion, the hardness difference in the cross section of the rail web portion may increase, and the fatigue damage resistance may deteriorate. For this reason, it is preferable that the Cu content be set to 1.00% or less, 0.80% or less, or 0.50% or less when Cu is included.

Ni: 0 to 1.00%

Ni improves the toughness of the pearlite structure, and at the same time, improves the hardness (strength) by solid solution strengthening. Particularly, Ni is an element that increases the hardness of the soft pearlite structure of the rail web portion, reduces the hardness difference in the pearlite structure, and improves the fatigue damage resistance of the rail web portion. In order to obtain the effects, it is preferable that the Ni content be set to 0.01% or greater, 0.02% or greater, or 0.10% or greater. On the other hand, when the Ni content exceeds 1.00%, due to a significant improvement in hardenability, the hard martensite structure may be likely to be formed in the rail web portion, the hardness difference in the cross section of the rail web portion may increase, and the fatigue damage resistance may deteriorate. For this reason, it is preferable that the Ni content be set to 1.00% or less, 0.80% or less, or 0.50% or less when Ni is included.

V: 0 to 0.50%

V increases the hardness (strength) of the pearlite structure by precipitation hardening caused by a V carbide and a V nitride formed in the process of cooling after hot rolling. Particularly, V is an element that increases the hardness of the soft pearlite structure of the rail web portion, reduces the hardness difference in the pearlite structure, and improves the fatigue damage resistance of the rail web portion. In order to obtain the effects, it is preferable that the V content be set to 0.005% or greater, 0.010% or greater, or 0.050% or greater. On the other hand, when the V content exceeds 0.50%, the precipitation hardening by the V carbide or nitride may be excessive, the pearlite structure may be embrittled, and the fatigue damage resistance of the rail web portion may deteriorate. For this reason, it is preferable that the V content be set to 0.50% or less, 0.40% or less, or 0.30% or less when V is included Nb: 0 to 0.050%

Similar to V, Nb increases the hardness (strength) of the pearlite structure by precipitation hardening caused by a Nb carbide and a Nb nitride formed in the process of cooling after hot rolling. Particularly, Nb is an element that increases the hardness of the soft pearlite structure of the rail web portion, reduces the hardness difference in the pearlite structure, and improves the fatigue damage resistance of the rail web portion. In order to obtain the effects, it is preferable that the Nb content be set to 0.0010% or greater, 0.0050% or greater, or 0.010% or greater. On the other hand, when the Nb content exceeds 0.050%, the precipitation hardening by the Nb carbide or nitride may be excessive, the pearlite structure may be embrittled, and the fatigue damage resistance of the rail web portion may deteriorate. For this reason, it is preferable that the Nb content be set to 0.050% or less, 0.040% or less, or 0.030% or less when Nb is included.

Ti: 0 to 0.0500%

Ti precipitates as a Ti carbide and a Ti nitride formed in the process of cooling after hot rolling, and increases the hardness (strength) of the pearlite structure by precipitation hardening. Particularly, Ti is an element that increases the hardness of the soft pearlite structure of the rail web portion, reduces the hardness difference in the pearlite structure, and improves the fatigue damage resistance of the rail web portion. In order to obtain the effects, it is preferable that the Ti content be set to 0.0030% or greater, 0.0100% or greater, or 0.0150% or greater. On the other hand, when the Ti content exceeds 0.0500%, a coarse Ti carbide and a coarse Ti nitride may be formed, and fatigue damage may be likely to occur in the rail web portion due to stress concentration. For this reason, it is preferable that the Ti content be set to 0.0500% or less, 0.0400% or less, or 0.0300% or less when Ti is included.

Mg: 0 to 0.0200%

Mg is an element that is bonded to S to form a fine sulfide (MgS). MgS finely disperses MnS. In addition, the finely dispersed MnS serves as a nucleus of the pearlitic transformation to promote pearlitic transformation, suppresses the formation of the pro-eutectoid ferrite or pro-eutectoid cementite structure to be formed in the rail web portion, reduces the hardness difference in the pearlite structure, and improves the fatigue damage resistance of the rail web portion. In order to obtain the effects, it is preferable that the Mg content be set to 0.0005% or greater, 0.0010% or greater, or 0.0050% or greater. On the other hand, when the Mg content exceeds 0.0200%, a coarse Mg oxide may be formed, and fatigue damage may be likely to occur in the rail web portion due to stress concentration. For this reason, it is preferable that the Mg content be set to 0.0200% or less, 0.0150% or less, or 0.0100% or less when Mg is included.

Ca. 0 to 0.0200%

Ca is an element that has a strong bonding force to S and forms a sulfide (CaS). The CaS finely disperses MnS. The fine MnS serves as a nucleus of pearlitic transformation to promote the pearlitic transformation, suppresses the formation of the pro-eutectoid ferrite or pro-eutectoid cementite structure to be formed in the rail web portion, reduces the hardness difference in the pearlite structure, and improves the fatigue damage resistance of the rail web portion. In order to obtain the effects, it is preferable that the Ca content be set to 0.0005% or greater, 0.0010% or greater, or 0.0050% or greater. On the other hand, when the Ca content exceeds 0.0200%, a coarse Ca oxide may be formed, and fatigue damage may be likely to occur due to stress concentration. For this reason, it is preferable that the Ca content be set to 0.0200% or less, 0.0150% or less, or 0.0100% or less when Ca is included.

REM: 0 to 0.0500%

REM is a deoxidizing and desulfurizing element, and forms an REM oxysulfide ($REM_2O_2S$) serving as a nucleus for forming a Mn sulfide-based inclusion when included. In addition, since the melting point of the oxysulfide ($REM_2O_2S$), which is a nucleus, is high, elongation of the Mn sulfide-based inclusion after hot rolling is suppressed. As a result, since REM is included, MnS is finely dispersed, MnS serves as a nucleus of pearlitic transformation, and the pearlitic transformation is promoted. As a result, the formation of the pro-eutectoid ferrite or pro-eutectoid cementite structure to be formed in the rail web portion is suppressed, the hardness difference in the pearlite structure is reduced, and the fatigue damage resistance of the rail web portion is improved. In order to obtain the effects, it is preferable that the REM content be set to 0.0005% or greater, 0.0010% or greater, or 0.0050% or greater. On the other hand, when the REM content exceeds 0.0500%, a coarse REM oxysulfide ($REM_2O_2S$) may be formed, and fatigue damage may be likely to occur in the rail web portion due to stress concentration. For this reason, it is preferable that the REM content be set to 0.0500% or less, 0.0400% or less, or 0.0300% or less when REM is included.

Here, REM is rare earth metals such as Ce, La, Pr, or Nd. The above content limits the total amount of all the REM elements. When the sum of the amounts of all the REM elements is in the above range, the same effects can be obtained even when REM included is in either of the form of a single element or the form of a plurality of elements.

Zr 0 to 0.0200%

Zr is bonded to O to form a $ZrO_2$ inclusion. Since the $ZiO_2$ inclusion has excellent lattice matching performance with γ-Fe, the $ZrO_2$ inclusion serves as a solidified nucleus of a high carbon rail steel in which y-Fe is a solidified primary phase, and increases the equiaxed crystal ratio of a solidification structure, and thus suppresses the formation of a segregation zone in the bloom or slab center portion, suppresses the formation of a martensite or pro-eutectoid cementite structure to be formed in the rail web portion, reduces the hardness difference in the pearlite structure, and improves the fatigue damage resistance of the rail web portion. In order to obtain the effects, it is preferable that the Zr content be set to 0.0001% or greater, 0.0010% or greater, or 0.0050% or greater. On the other hand, when the Zr content exceeds 0.0200%, a large amount of coarse Zr-based inclusions may be formed, and fatigue damage may be likely to occur in the rail web portion due to stress concentration. For this reason, it is preferable that the Zr content be set to 0.0200%, 0.0150%, or 0.0100% when Zr is included.

N: 0 to 0.0200%

N segregates in an austenite grain boundary, and thus promotes pearlitic transformation from the austenite grain boundary, suppresses the formation of the pro-eutectoid ferrite or pro-eutectoid cementite structure to be formed in the rail web portion, reduces the hardness difference in the pearlite structure, and improves the fatigue damage resistance of the rail web portion. In addition, when N is included together with V, the precipitation of a V carbonitride in the process of cooling after hot rolling is promoted, the hardness (strength) of the pearlite structure is increased, and the fatigue damage resistance of the rail web portion is improved. In order to obtain the effects, it is preferable that the N content be set to 0.0060% or greater, 0.0080% or greater, or 0.0100% or greater. On the other hand, when the N content exceeds 0.0200%, it may be difficult to solid-solubilize N in the steel. In this case, bubbles as the origin of fatigue damage may be formed, and fatigue damage may be likely to occur in the rail web portion. For this reason, it is preferable that the N content be set to 0.0200% or less, 0.0180% or less, or 0.0150% or less when N is included.

Al: 0 to 1.00%

Al is a component that functions as a deoxidation material. In addition, Al is an element that moves the eutectoid transformation temperature to a high-temperature side, and is an element that contributes to an increase in hardness (strength) of the pearlite structure, increases the hardness of the soft pearlite structure of the rail web portion, reduces the hardness difference in the pearlite structure, and improves the fatigue damage resistance of the rail web portion. In order to obtain the effects, it is preferable that the Al content be set to 0.0100% or greater, 0.0500% or greater, or 0.1000% or greater. On the other hand, when the Al content exceeds 1.00%, it may be difficult to solid-solubilize Al in the steel. In this case, a coarse alumina-based inclusion may be formed, fatigue cracks may initiate from the coarse precipitate, and fatigue damage may be likely to occur in the rail web portion. Further, in this case, an oxide may be formed during welding of the rail, and weldability significantly may deteriorate. For this reason, it is preferable that the Al content be set to 1.00% or less, 0.80% or less, or 0.60% or less when Al is included.

(2) Metallographic Structure

The reason for limiting 90 area % or greater of a metallographic structure in the cross section of the web portion to the pearlite structure in the rail according to the present embodiment will be described in detail. Incidentally, the "metallographic structure in the cross section of the rail web portion" indicates a metallographic structure in a range of ±15 mm in the upward and downward direction of the rail from the middle line between the rail bottom portion and the rail top portion in the cross section of the web portion.

First, the reason for limiting 90 area % or greater to the pearlite structure will be described.

The pearlite structure is a structure that is advantageous to improving the fatigue damage resistance since the strength (hardness) can be easily obtained even when the amount of alloying elements is small. Further, the strength (hardness) of the pearlite structure can be easily controlled. Therefore, in order to improve the fatigue damage resistance of the cross section of the rail web portion, the amount of the pearlite structure was limited to a predetermined amount or greater.

Figure 5:
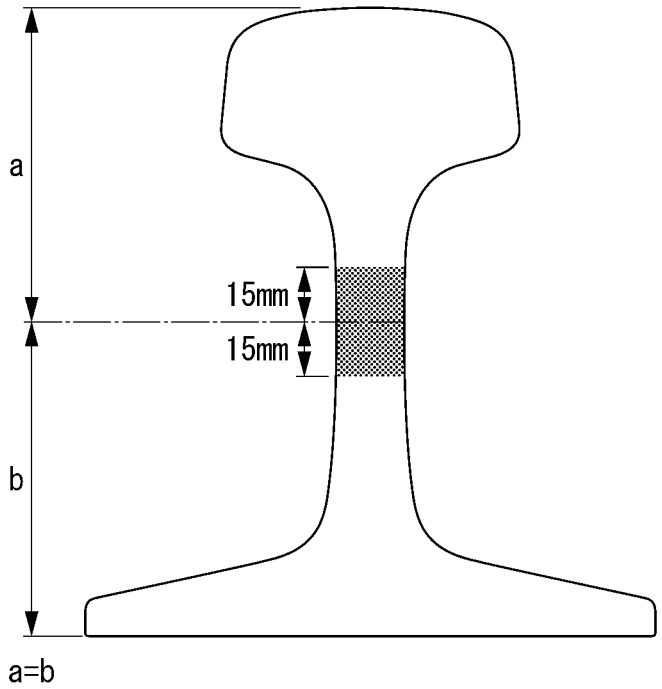
FIG. 5 is a range of the web portion, which requires a pearlite structure.

In addition, a region in which the metallographic structure is controlled in the cross section of the rail web portion is a portion that requires fatigue damage resistance in the rail web portion. FIG. 5 shows the range of the web portion requiring the pearlite structure. At least 90 area % or greater of the metallographic structure in a range of ±15 mm in the upward and downward direction of the rail from the middle line between the rail bottom portion and the rail top portion may be the pearlite structure.

It is desirable that the metallographic structure in the cross section of the web portion of the rail according to the present embodiment be the pearlite structure as described above, but depending on a component system of the rail or a heat treatment production method, a pro-eutectoid ferrite structure, a pro-eutectoid cementite structure, a bainite structure, or a martensite structure may be mixed in the pearlite structure in a small amount of 10% or less by area ratio. However, even when these structures are mixed, if the amount is a small amount, these structures do not greatly affect the hardness of the rail web portion, and do not greatly adversely affect the fatigue damage resistance of the rail web portion. For this reason, as a structure of the web portion of the rail having excellent fatigue damage resistance, the pro-eutectoid ferrite structure, the pro-eutectoid cementite structure, the bainite structure, and the martensite structure are allowed to be mixed in a small amount of 10 area % or less. In other words, 90 area % or greater of the metallographic structure in the cross section of the web portion of the rail according to the present embodiment may be the pearlite structure. In order to sufficiently improve the fatigue damage resistance, it is desirable that 92 area % or greater, 95 area % or greater, or 98 area % or greater of the metallographic structure in the cross section of the web portion be a pearlite structure.

A method for observing and quantifying the structure in the cross section of the rail web portion is as follows.

[Method for Observing and Quantifying Structure in Cross Section of Rail Web Portion]

Observation Method

- Device: optical microscope
- Collection of test piece for observation: a sample was cut out from a cross section in a range of ±15 mm in the upward and downward direction of the rail from the middle line between the rail bottom portion and the rail top portion (refer to FIG. 5).
- Pre-processing: the cross section was polished with a diamond grit having an average grain size of 1 μm, and nital etching was performed.
- Observation magnification: 200

Observation Position

- Position: a position at 1.0 mm from the outer surface of the rail web portion and the position of the thickness center of the web portion Quantification of Structure Number of observations: five or more visual fields at each of the position at 1.0 mm from the outer surface and the position of the thickness center of the web portion Quantification: the average value of the area ratios (a total of 10 or more visual fields) of pearlite at the position at 1.0 mm from the outer surface (five or more visual fields) and at the position of the thickness center of the web portion (five or more visual fields) was defined as the area ratio of the pearlite included in the metallographic structure in the cross section of the rail web portion.

(3) Reason for Limiting Minimum Value of Cross-Sectional Hardness of Web Portion The reason for limiting the minimum value of the hardness in the cross section of the rail web portion in the rail according to the present embodiment to a range of Hv 300 or greater will be described. Incidentally, the "minimum value of the hardness in the cross section of the rail web portion" indicates the minimum value of the hardness in a range of ±15 mm in the upward and downward direction of the rail from the middle line between the rail bottom portion and the rail top portion in the cross section of the web portion.

When the minimum value of the cross-sectional hardness of the web portion is less than Hv 300, in a use environment of heavy-duty railways, a fatigue crack initiates from the web portion, fatigue strength cannot be ensured, and the fatigue damage resistance of the rail web portion deteriorates. For this reason, the minimum value of the cross-sectional hardness of the web portion is limited to a range of Hv 300 or greater. Incidentally, in order to stably ensure the fatigue damage resistance of the rail web portion, it is desirable that the minimum value of the cross-sectional hardness of the web portion be set to Hv 320 or greater, Hv 340 or greater, or Hv 360 or greater. The maximum value of the cross-sectional hardness of the web portion is not particularly limited as long as the requirements for the hardness difference to be described later are satisfied, but in order to prevent a deterioration in toughness of the rail web portion, it is desirable that the minimum value of the cross-sectional hardness of the web portion be set to Hv 450 or less, Hv 420 or less, or Hv 400 or less.

(4) Reason for Limiting Difference Between Maximum Value and Minimum Value of Hardness in Cross Section of Rail Web Portion The reason for limiting the difference between the maximum value and the minimum value of the hardness in the cross section of the rail web portion to a range of Hv 40 or less in the rail according to the present embodiment will be described. Incidentally, the "difference between the maximum value and the minimum value of the hardness in the cross section of the rail web portion" indicates a difference between the maximum value and the minimum value of the hardness in a range of ±15 mm in the upward and downward direction of the rail from the middle line between the rail bottom portion and the rail top portion in the cross section of the web portion.

When the difference between the maximum value and the minimum value of the cross-sectional hardness of the web portion exceeds Hv 40, in heavy-duty railways, the strain of the web portion applied to the rail web portion is concentrated in a portion in which the hardness is significantly nonuniform, and a crack initiates, so that the fatigue damage resistance of the rail web portion deteriorates. For this reason, the difference between the maximum value and the minimum value of the cross-sectional hardness of the rail web portion is limited to a range of Hv 40 or less.

Further, in order to even further improve the fatigue damage resistance of the rail web portion, it is desirable that the difference between the maximum value and the minimum value of the cross-sectional hardness of the rail web portion be limited to a range of Hv 30 or less, Hv 20 or less, or Hv 15 or less. Incidentally, it is not necessary to limit the lower limit value of the difference between the maximum value and the minimum value of the cross-sectional hardness of the rail web portion, and the lower limit value may be set to Hv 0, but the difference between the maximum value and the minimum value of the cross-sectional hardness of the rail web portion is typically set to Hv 10 or greater.

The cross-sectional hardness of the rail web portion is measured under the following conditions.

[Method for Measuring Cross-Sectional Hardness of Rail Web Portion, Measurement Conditions, and Method for Organizing Hardness]

Measurement Device and Method

Device: Vickers hardness meter (load of 98 N)

Collection of test piece for measurement: a sample was cut out from a cross section of the rail web portion Pre-processing: the cross section was polished with a diamond grit having an average grain size of 1 μm Measurement method: the hardness was measured according to JIS Z 2244: 2009

Measurement Position

The measurement position was in a cross section in a range of ±15 mm in an upward and downward direction of the rail from a middle line between a rail bottom portion and a rail top portion (refer to FIG. 1).

Indentations were continuously made in the thickness direction of the web portion in a row at a pitch of 1.0 mm in which the starting point of the continuous indentation is the position of a depth of 1.0 mm from the outer surface of the web portion, and the hardness was measured. The measurement of the hardness was performed on at least five lines.

Incidentally, in order to eliminate the mutual influences of the indentations, an interval of 1.0 mm or greater was provided between the measurement lines.

Method for Organizing Hardness

The minimum value and the maximum value of the measured hardness were defined as the minimum value and the maximum value of the cross-sectional hardness of the rail web portion.

(5) Method of Controlling Cross-Sectional Hardness of Rail Web Portion

The cross-sectional hardness of the rail web portion can be controlled by adjusting, for example, hot rolling conditions, and controlled cooling conditions for the head portion and the web portion after hot rolling.

Since the rail according to the present embodiment includes the composition, the metallographic structures, and the hardness described above, the effects can be obtained regardless of the production method. However, for example, the rail can be obtained by melting rail steel including the above-described composition in a melting furnace typically used, such as a converter or an electric furnace, casting the molten steel by an ingot-making and blooming method or a continuous casting method, performing hot rolling on the obtained bloom or slab, and performing controlled cooling on the surface of the rail web portion to control the cross-sectional hardness of the rail web portion.

For example, in a method for producing the rail according to the present embodiment, a molten steel after adjustment of composition is casted to obtain a bloom, and the bloom is heated to 1250 to 1300° C. and is hot-rolled into a rail shape. Then, the rail according to the present embodiment can be obtained by performing either of controlled cooling on the surface of the rail web portion after hot rolling and controlled cooling on the surface of the rail web portion after hot rolling, natural cooling, and then re-heating.

In a series of the processes, in order to adjust the cross-sectional hardness of the web portion, production conditions such as hot rolling conditions, controlled cooling conditions after hot rolling, re-heating conditions after hot rolling, and controlled cooling conditions after re-heating may be controlled. Incidentally, production temperature conditions to be described below should be applied to the entire surface of the rail web portion (outer surface of the rail web portion). Even when the production temperature conditions are applied to the surface of the rail head portion, it is considered that the thermal history and the like of the surface of the rail web portion are not suitably controlled. The rail head portion and the rail web portion have different thicknesses, and thus have, for example, different degrees of reheat and the like during cooling. For this reason, it is inevitable that the surfaces of the rail head portion and the rail web portion have different thermal histories.

Suitable Hot Rolling Conditions and Re-Heating Conditions

In order to ensure the cross-sectional hardness of the rail web portion, the final rolling temperature in the web portion is set to 750 to 1000° C. (outer surface temperature of the rail web portion), so that the minimum value of the cross-sectional hardness of the web portion can be ensured.

As a hot rolling method, a bloom or slab is roughly rolled with reference to the method described in, for example, Patent Document 6 and the like. Thereafter, intermediate rolling is performed in a plurality of passes using a reverse mill, and subsequently, finish rolling is performed in two or more passes using a continuous mill, which is a desirable method.

In addition, when the rail is temporarily cooled after hot rolling, and then is subjected to re-heating, as the re-heating conditions, for example, re-heating is performed such that the re-heating temperature of the rail web portion is in a range of 800 to 1100° C. (outer surface temperature of the rail web portion), so that the minimum value of the cross-sectional hardness of the rail web portion can be ensured.

Suitable Controlled Cooling Conditions after Hot Rolling and Controlled Cooling Conditions after Re-Heating A technique for performing controlled cooling on the rail web portion is not particularly limited. In order to impart fatigue damage resistance and control the cross-sectional hardness, controlled cooling is carried out on the rail web portion during heat treatment using air injection cooling, mist cooling, water/air mixture injection cooling, or a combination thereof. Incidentally, the cooling rate and the cooling temperature range in the controlled cooling are controlled based on the outer surface temperature of the rail web portion as described above.

Controlled cooling is performed for the purpose of uniformizing the cross-sectional hardness of the rail web portion. In the web portion, a segregation zone is present and the hardness is likely to be nonuniform. Therefore, in the controlled cooling, in order to suppress a rise in hardness of the segregation zone, accelerated cooling is temporarily stopped after accelerated cooling of a first stage, the temperature is retained by using a temperature rise caused by internal reheat and slight accelerated cooling, and a rise in hardness of a segregation portion is suppressed. Specifically, slight accelerated cooling (controlled cooling) is performed by the spraying of a cooling medium such that the temperature rise of the outer surface of the web portion caused by reheat and the temperature decrease of the outer surface of the web portion by the spraying of the cooling medium are balanced to cause the outer surface temperature of the web portion to be substantially constant. After the end of the temperature retention, accelerated cooling of a second stage for ensuring the hardness is carried out. The suitable cooling condition range is as shown below. Incidentally, the average cooling rate of the accelerated cooling is a value obtained by an average cooling rate during spraying of the cooling medium, namely, a difference between a cooling medium spraying start temperature and a cooling medium spraying end temperature by a cooling medium spraying time.

(1) When Controlled Cooling is Performed after Hot Rolling
- Controlled portion: outer surface of the rail web portion
- Average cooling rate during accelerated cooling of first stage: 0.5 to 5.0° C./sec
- Cooling stop temperature range. 580 to 680° C.
- Temperature retention: 20 to 200 sec in a range of 580 to 680° C. (slight accelerated cooling is carried out)
- Average cooling rate during accelerated cooling of second stage: 2.0 to 5.0° C./sec
- Cooling stop temperature range: 500° C. or less (2) When Controlled Cooling is Performed after Re-Heating
- Controlled portion: outer surface of the rail web portion
- Average cooling rate during accelerated cooling of first stage: 1.0 to 6.0° C./sec
- Cooling stop temperature range. 580 to 680° C.
- Temperature retention: 20 to 200 sec in a range of 580 to 680° C. (slight accelerated cooling is carried out)
- Average cooling rate during accelerated cooling of second stage: 2.0 to 5.0° C./sec
- Cooling stop temperature range: 500° C. or less The controlled cooling of the web portion was carried out by injecting a cooling medium such as air or cooling water onto either of the surface of the rail web portion and the surface of the head portion or both of the surfaces. In addition, the temperature retention can be controlled by repeating slight accelerated cooling depending on the amount of the temperature rise by the generation of reheat.

Incidentally, the portion which is subjected to controlled cooling is the rail web portion, but when cooling is performed on the rail in a standing posture (head is on an upper side), the cooling medium may be injected onto the surface of the rail head portion, and the cooling medium may flow to the surface of the rail web portion to cool the rail web portion. Therefore, as described above, the direct cooling of the surface of the rail web portion is not necessarily required. However, it is needless to say that even when the cooling medium is injected onto the surface of the rail head portion, the control target is the outer surface temperature of the web portion.

Suitable Material and Production Conditions for Rail Head Portion and Foot Portion The material of the rail head portion and the rail foot portion is not particularly limited. It is desirable to have a structure in which even when the amount of alloying elements is small, the strength (hardness) can be easily obtained, and wear resistance or fatigue damage resistance is ensured.

It is desirable that the rail head portion is the pearlite structure having a hardness of Hv 340 or greater in order to ensure wear resistance.

It is desirable that the rail foot portion is also the metallographic structure having a hardness of Hv 300 or greater in order to ensure fatigue damage resistance. Since it is not necessary to ensure wear resistance in the foot portion, the foot portion is not limited to including a pearlite structure, and may include a metallographic structure such as bainite having excellent balance between strength and ductility.

In addition, in order to ensure the hardness, it is desirable to perform a heat treatment on the rail head portion after hot rolling or re-heating. The hardness of the rail head portion can be ensured by performing accelerated cooling using the methods described in Patent Document 1, Patent Document 7, and the like. In order to ensure the hardness of the rail foot portion, achieve balance between the rail foot portion and the head portion during heat treatment, and suppress bending, it is desirable to perform the same accelerated cooling as that for the rail head portion.

The rail according to the present embodiment can be produced by combining and utilizing the method for controlling the hardness of the rail head portion and the new findings obtained by the present inventors.

EXAMPLES

Next, examples of the present invention will be described.

Table 1 shows the chemical compositions (steel composition) of rails in examples of the present invention. In Table 1, the remainder of the chemical composition is iron and impurities, and the amount of an element which is not intentionally added is described as "-".

Table 3 shows the pearlite fraction (area %) in the cross section of the web portion, the minimum value (Hv) of the cross-sectional hardness of the web portion, and the difference (Hv) between the maximum value and the minimum value of the cross-sectional hardness of the web portion. Further, Table 3 also shows results of the fatigue tests performed using the method shown in FIG. 2. When the pearlite fraction in the cross section of the web portion is described as 90%, the area ratio of the pearlite structure in the cross section of the rail web portion is 90%, and one or two or more of a pro-eutectoid ferrite structure, a pro-eutectoid cementite structure, a bainite structure, and a martensite structure are mixed in a small amount of 10% by area ratio.

On the other hand. Table 2 shows the chemical compositions of rails in comparative examples. In Table 2, the remainder of the chemical composition is iron and impurities, and the amount of an element which is not intentionally added is described as "-".

Table 4 shows the pearlite fraction (area %) in the cross section of the web portion, the minimum value (Hv) of the cross-sectional hardness of the web portion, and the difference (Hv) between the maximum value and the minimum value of the cross-sectional hardness of the web portion. Further, Table 4 also shows results of the fatigue tests performed using the method shown in FIG. 2. When the pearlite fraction in the cross section of the web portion is described as 86%, the area ratio of the pearlite structure in the cross section of the rail web portion is 86%, and one or two or more of a pro-eutectoid ferrite structure, a pro-eutectoid cementite structure, a bainite structure, and a martensite structure are mixed in a small amount of 14% by area ratio.

Incidentally, the outline of production processes and production conditions for the rails of the present invention and the comparative rails shown in Tables 1 to 4 is as shown below in two sections.

[Production Process of Rails of Present Invention]

Basic Conditions (Direct Controlled Cooling is Carried Out without Cooling and Re-Heating after Hot Rolling)

Molten steel→adjustment of composition→casting (bloom)→re-heating (1250 to 1300° C.)→hot rolling→controlled cooling Re-Heating Conditions Molten steel→adjustment of composition→casting→re-heating→hot rolling→natural cooling→re-heating (rail)→controlled cooling In addition, the outline of production conditions for the rails of the present invention shown in Tables 1 and 3 is as shown below. Regarding production conditions for the comparative rails shown in Tables 2 and 4, Comparative Examples D to K were produced under the basic conditions (controlled cooling after hot rolling) for the rails of the present invention, and Comparative Examples A to C were produced under conditions in which one condition deviated from the production conditions for the rails of the present invention.

[Production Conditions for Rails of Present Invention]

Basic Conditions (Controlled Cooling after Hot Rolling)

Hot Rolling Conditions

Controlled portion: outer surface of the rail web portion

Final rolling temperature: 750 to 1000° C.

Controlled Cooling Conditions

Controlled portion: outer surface of the rail web portion

Average cooling rate during accelerated cooling of first stage: 0.5 to 5.0° C./sec Cooling stop temperature range: 580 to 680° C.

Temperature retention: 20 to 200 sec in a range of 580 to 680° C. (slight accelerated cooling is carried out)

Average cooling rate during accelerated cooling of second stage: 2.0 to 5.0° C./sec Cooling stop temperature range: 500° C. or less Re-Heating Conditions (Controlled Cooling after Re-Heating) Heating Conditions Controlled portion: outer surface of the rail web portion Heating temperature 800 to 1100° C.

Controlled Cooling Conditions

Controlled portion: outer surface of the rail web portion

Average cooling rate during accelerated cooling of first stage: 1.0 to 6.0° C./sec Cooling stop temperature range: 580 to 680° C.

Temperature retention; 20 to 200 sec in a range of 580 to 680° C.

(slight accelerated cooling is carried out)

Average cooling rate during accelerated cooling of second stage: 2.0 to 5.0° C./sec Cooling stop temperature range: 500° C. or less Incidentally, the details of the rails of the present invention and the comparative rails shown in Tables 1 to 4 are as shown below.

(1) Rails of Present Invention (37 Pieces)

Invention Examples 1 to 37 were rails in which the chemical composition values, the pearlite fraction in the cross section of the web portion, the minimum value of the cross-sectional hardness of the web portion, and the difference between the maximum value and the minimum value of the cross-sectional hardness of the web portion were in the ranges described in the present invention.

Invention Examples 1 to 18 and 23 to 37 were rails produced under the basic conditions (direct controlled cooling was carried out after hot rolling), and Invention Examples 19 to 22 were rails produced under the re-heating conditions.

(2) Comparative Rails (11 Pieces)

Comparative Examples A to C (3 pieces) were rails in which one of the pearlite fraction in the cross section of the web portion, the minimum value of the cross-sectional hardness of the web portion, and the difference between the maximum value and the minimum value of the cross-sectional hardness of the web portion was outside the ranges described in the present invention.

Here, regarding production conditions for the rail in Comparative Example A, the average cooling rate in the accelerated cooling of a first stage was 0.2° C./sec, and other conditions were the same as those for the rails of the present invention. Regarding production conditions for the rail in Comparative Example B, the final hot rolling temperature was 700° C., and other conditions were the same as those for the rails of the present invention. Regarding production conditions for the rail in Comparative Example C, the temperature retention time was 10 seconds, and other conditions were the same as those for the rails of the present invention. In addition, all the rails in Comparative Examples A to C were subjected to direct controlled cooling after hot rolling.

Comparative Examples D to K (8 pieces) were rails in which one of C, Si, Mn, P, and S contents was outside the ranges described in the present invention. All the rails in Comparative Examples D to K were subjected to direct controlled cooling after hot rolling.

A method for observing the structure in the cross section of the rail web portion is as shown below.

[Method for Observing Structure in Cross Section of Rail Web Portion]

Observation Method

- Device: optical microscope
- Collection of test piece for observation: a sample was cut out from a cross section in a range of ±15 mm in the upward and downward direction of the rail from the middle line between the rail bottom portion and the rail top portion (refer to FIG. 5).
- Pre-processing: the cross section was polished with a diamond grit having an average grain size of 1 μm, and nital etching was performed.
- Observation magnification: 200

Observation Position

- Position: a position at 1.0 mm from the outer surface of the rail web portion and the position of the thickness center of the web portion Quantification of Structure

- Number of observations: five or more visual fields at each of the position at 1.0 mm from the outer surface of the rail web portion and the position of the thickness center of the web portion
- Quantification: the average value of the area ratios (a total of 10 or more visual fields) of pearlite at the position at 1.0 mm from the outer surface of the rail web portion (four or more visual fields) and at the position of the thickness center of the web portion (five or more visual fields) was defined as the area ratio of the pearlite included in the metallographic structure in the cross section of the rail web portion.

A method for measuring the hardness in the cross section of the rail web portion and measurement conditions are as shown below.

[Method for Measuring Cross-Sectional Hardness of Rail Web Portion, Measurement Conditions, and Method for Organizing Hardness]

Measurement Device and Method

- Device: Vickers hardness meter (load of 98 N)
- Collection of test piece for measurement: a sample was cut out from a cross section of the rail web portion
- Pre-processing: the cross section was polished with a diamond grit having an average grain size of 1 μm
- Measurement method: the hardness was measured according to JIS Z 2244: 2009

Measurement Position

The measurement position was in a cross section in a range of ±15 mm in an upward and downward direction of the rail from a middle line between a rail bottom portion and a rail top portion (refer to FIG. 1).

Indentations were continuously made in the thickness direction of the web portion in a row at a pitch of 1.0 mm in which the starting point of the continuous indentation is the position of a depth of 1.0 mm from the outer surface of the web portion, and the hardness was measured. The measurement of the hardness was performed on at least five lines.

Incidentally, in order to eliminate the mutual influences of the indentations, an interval of 1.0 mm or greater was provided between the measurement lines.

Method for Organizing Hardness

The minimum value and the maximum value of the measured hardness were defined as the minimum value and the maximum value of the cross-sectional hardness of the rail web portion.

In addition, fatigue test conditions for the rail are as shown below.

[Fatigue Test of Rail (Refer to FIG. 2)]

- Test method: bending of the actual rail at three points (span length: 650 mm)
- Load conditions: fluctuation in a range of 2 to 20 tons.
- Frequency of fluctuation in applied load: 5 Hz
- Test posture: an eccentric load was applied to the rail head portion. The position of application of the load was set to a position shifted by one third of the width of the rail head portion from the center of the rail head portion in a width direction of the rail (refer to FIG. 2). (tensile stress was applied to the rail web portion to reproduce a curved track).
- Measurement of stress: the stress was measured with a strain gauge attached to the rail web portion
- Number of repetitions of load fluctuation: up to 3 million repetitions at the maximum (without initiation of a crack) or until the initiation of a crack.
- Determination of crack: the test was periodically stopped, and a magnetic particle inspection was performed on the surface of the rail web portion to confirm whether or not a crack was present in the surface of the rail web portion
- Determination of pass: the rail in which the number of repetitions of load fluctuation until the initiation of a crack was 2 million or greater or a crack did not initiate until the end of the test (load fluctuated 3 million repetitions) was determined as a rail having excellent fatigue breakage resistance The test results are organized as follows.

Passed Material

- Evaluation S: no crack initiated up to 3 million repetitions at the end of the test.
- Evaluation A: the number of times at the time of initiation of a crack was 2.5 million or greater and less than 3 million
- Evaluation B: the number of times at the initiation of a crack was 2.3 million or greater and less than 2.5 million.
- Evaluation C: the number of times at the initiation of a crack was 2 million or greater and less than 2.3 million.

Rejected Material

Evaluation X: the number of times at the initiation of a crack was less than 2 million.

The evaluation results of the invention examples are shown in Table 3, and the evaluation results of the comparative examples are shown in Table 4.

TABLE 1

| | | C | Si | Mn | P | S | Cr | Mo | Co | B | Cu |
|---|---|---|---|---|---|---|---|---|---|---|---|
| 1 | Invention example | 0.90 | 0.50 | 0.70 | 0.015 | 0.012 | — | — | — | — | — |
| 2 | Invention example | 0.80 | 0.40 | 1.20 | 0.015 | 0.012 | — | — | — | — | — |
| 3 | Invention example | 1.00 | 0.60 | 0.85 | 0.015 | 0.012 | — | — | — | — | — |
| 4 | Invention example | 1.10 | 1.00 | 0.45 | 0.015 | 0.012 | — | — | — | — | — |
| 5 | Invention example | 1.20 | 0.50 | 0.70 | 0.015 | 0.012 | — | — | — | — | — |
| 6 | Invention example | 0.75 | 0.50 | 0.70 | 0.015 | 0.012 | — | — | — | — | — |
| 7 | Invention example | 0.90 | 2.00 | 0.70 | 0.015 | 0.012 | — | — | — | — | — |
| 8 | Invention example | 0.90 | 0.10 | 0.70 | 0.015 | 0.012 | — | — | — | — | — |
| 9 | Invention example | 0.90 | 0.50 | 2.00 | 0.015 | 0.012 | — | — | — | — | — |
| 10 | Invention example | 0.90 | 0.50 | 0.10 | 0.015 | 0.012 | — | — | — | — | — |
| 11 | Invention example | 0.90 | 0.50 | 0.70 | 0.025 | 0.012 | — | — | — | — | — |
| 12 | Invention example | 0.90 | 0.50 | 0.70 | 0.015 | 0.025 | — | — | — | — | — |
| 13 | Invention example | 0.90 | 0.50 | 0.70 | 0.015 | 0.012 | — | — | — | — | — |
| 14 | Invention example | 0.90 | 0.50 | 0.70 | 0.015 | 0.012 | — | — | — | — | — |
| 15 | Invention example | 0.90 | 0.50 | 0.70 | 0.015 | 0.012 | — | — | — | — | — |
| 16 | Invention example | 0.90 | 0.50 | 0.70 | 0.015 | 0.012 | — | — | — | — | — |
| 17 | Invention example | 0.90 | 0.50 | 0.70 | 0.015 | 0.012 | — | — | — | — | — |
| 18 | Invention example | 0.90 | 0.50 | 0.70 | 0.015 | 0.012 | — | — | — | — | — |
| 19 | Invention example | 1.00 | 0.60 | 0.85 | 0.015 | 0.012 | — | — | — | — | — |
| 20 | Invention example | 1.00 | 0.60 | 0.85 | 0.015 | 0.012 | — | — | — | — | — |
| 21 | Invention example | 1.00 | 0.60 | 0.85 | 0.015 | 0.012 | — | — | — | — | — |
| 22 | Invention example | 1.00 | 0.60 | 0.85 | 0.015 | 0.012 | — | — | — | — | — |
| 23 | Invention example | 0.90 | 0.50 | 0.70 | 0.015 | 0.012 | 2.00 | — | — | — | — |
| 24 | Invention example | 0.90 | 0.50 | 0.70 | 0.015 | 0.012 | — | 0.50 | — | — | — |
| 25 | Invention example | 0.90 | 0.50 | 0.70 | 0.015 | 0.012 | — | — | 1.00 | — | — |
| 26 | Invention example | 0.90 | 0.50 | 0.70 | 0.015 | 0.012 | — | — | — | 0.0050 | — |
| 27 | Invention example | 0.90 | 0.50 | 0.70 | 0.015 | 0.012 | — | — | — | — | 1.00 |
| 28 | Invention example | 0.90 | 0.50 | 0.70 | 0.015 | 0.012 | — | — | — | — | — |
| 29 | Invention example | 0.90 | 0.50 | 0.70 | 0.015 | 0.012 | — | — | — | — | — |
| 30 | Invention example | 0.90 | 0.50 | 0.70 | 0.015 | 0.012 | — | — | — | — | — |
| 31 | Invention example | 0.90 | 0.50 | 0.70 | 0.015 | 0.012 | — | — | — | — | — |
| 32 | Invention example | 0.90 | 0.50 | 0.70 | 0.015 | 0.012 | — | — | — | — | — |
| 33 | Invention example | 0.90 | 0.50 | 0.70 | 0.015 | 0.012 | — | — | — | — | — |
| 34 | Invention example | 0.90 | 0.50 | 0.70 | 0.015 | 0.012 | — | — | — | — | — |
| 35 | Invention example | 0.90 | 0.50 | 0.70 | 0.015 | 0.012 | — | — | — | — | — |
| 36 | Invention example | 0.90 | 0.50 | 0.70 | 0.015 | 0.012 | — | — | — | — | — |
| 37 | Invention example | 0.90 | 0.50 | 0.70 | 0.015 | 0.012 | — | — | — | — | — |

| | | Ni | V | Nb | Ti | Mg | Ca | REM | Zr | N | Al |
|---|---|---|---|---|---|---|---|---|---|---|---|
| 1 | Invention example | — | — | — | — | — | — | — | — | — | — |
| 2 | Invention example | — | — | — | — | — | — | — | — | — | — |
| 3 | Invention example | — | — | — | — | — | — | — | — | — | — |
| 4 | Invention example | — | — | — | — | — | — | — | — | — | — |
| 5 | Invention example | — | — | — | — | — | — | — | — | — | — |
| 6 | Invention example | — | — | — | — | — | — | — | — | — | — |
| 7 | Invention example | — | — | — | — | — | — | — | — | — | — |
| 8 | Invention example | — | — | — | — | — | — | — | — | — | — |
| 9 | Invention example | — | — | — | — | — | — | — | — | — | — |
| 10 | Invention example | — | — | — | — | — | — | — | — | — | — |
| 11 | Invention example | — | — | — | — | — | — | — | — | — | — |
| 12 | Invention example | — | — | — | — | — | — | — | — | — | — |
| 13 | Invention example | — | — | — | — | — | — | — | — | — | — |
| 14 | Invention example | — | — | — | — | — | — | — | — | — | — |
| 15 | Invention example | — | — | — | — | — | — | — | — | — | — |
| 16 | Invention example | — | — | — | — | — | — | — | — | — | — |
| 17 | Invention example | — | — | — | — | — | — | — | — | — | — |
| 18 | Invention example | — | — | — | — | — | — | — | — | — | — |
| 19 | Invention example | — | — | — | — | — | — | — | — | — | — |
| 20 | Invention example | — | — | — | — | — | — | — | — | — | — |
| 21 | Invention example | — | — | — | — | — | — | — | — | — | — |
| 22 | Invention example | — | — | — | — | — | — | — | — | — | — |
| 23 | Invention example | — | — | — | — | — | — | — | — | — | — |
| 24 | Invention example | — | — | — | — | — | — | — | — | — | — |
| 25 | Invention example | — | — | — | — | — | — | — | — | — | — |
| 26 | Invention example | — | — | — | — | — | — | — | — | — | — |
| 27 | Invention example | — | — | — | — | — | — | — | — | — | — |
| 28 | Invention example | 1.00 | — | — | — | — | — | — | — | — | — |
| 29 | Invention example | — | 0.500 | — | — | — | — | — | — | — | — |
| 30 | Invention example | — | — | 0.050 | — | — | — | — | — | — | — |
| 31 | Invention example | — | — | — | 0.050 | — | — | — | — | — | — |
| 32 | Invention example | — | — | — | — | 0.020 | — | — | — | — | — |
| 33 | Invention example | — | — | — | — | — | 0.020 | — | — | — | — |
| 34 | Invention example | — | — | — | — | — | — | 0.050 | — | — | — |
| 35 | Invention example | — | — | — | — | — | — | — | 0.020 | — | — |
| 36 | Invention example | — | — | — | — | — | — | — | — | 0.020 | — |
| 37 | Invention example | — | — | — | — | — | — | — | — | — | 1.000 |

TABLE 2

| | | C | Si | Mn | P | S | Cr | Mo | Co | B | Cu | Ni | V | Nb | Ti | Mg | Ca | REM | Zr | N | Al |
|---|---|---|---|---|---|---|---|---|---|---|---|---|---|---|---|---|---|---|---|---|---|
| A | Comparative example | 0.90 | 0.50 | 0.70 | 0.015 | 0.012 | — | — | — | — | — | — | — | — | — | — | — | — | — | — | — |
| B | Comparative example | 0.90 | 0.50 | 0.70 | 0.015 | 0.012 | — | — | — | — | — | — | — | — | — | — | — | — | — | — | — |
| C | Comparative example | 0.90 | 0.50 | 0.70 | 0.015 | 0.012 | — | — | — | — | — | — | — | — | — | — | — | — | — | — | — |
| D | Comparative example | 1.24 | 0.50 | 0.70 | 0.015 | 0.012 | — | — | — | — | — | — | — | — | — | — | — | — | — | — | — |
| E | Comparative example | 0.71 | 0.50 | 0.70 | 0.015 | 0.012 | — | — | — | — | — | — | — | — | — | — | — | — | — | — | — |
| F | Comparative example | 0.90 | 2.04 | 0.70 | 0.015 | 0.012 | — | — | — | — | — | — | — | — | — | — | — | — | — | — | — |
| G | Comparative example | 0.90 | 0.06 | 0.70 | 0.015 | 0.012 | — | — | — | — | — | — | — | — | — | — | — | — | — | — | — |
| H | Comparative example | 0.90 | 0.50 | 2.04 | 0.015 | 0.012 | — | — | — | — | — | — | — | — | — | — | — | — | — | — | — |
| I | Comparative example | 0.90 | 0.50 | 0.06 | 0.015 | 0.012 | — | — | — | — | — | — | — | — | — | — | — | — | — | — | — |
| J | Comparative example | 0.90 | 0.50 | 0.70 | 0.030 | 0.012 | — | — | — | — | — | — | — | — | — | — | — | — | — | — | — |
| K | Comparative example | 0.90 | 0.50 | 0.70 | 0.015 | 0.029 | — | — | — | — | — | — | — | — | — | — | — | — | — | — | — |

TABLE 3

| | Pearlite fraction of cross section of web portion (%) | Minimum value of cross-sectional hardness of web portion (Hv) | Difference between maximum value and minimum value of cross-sectional hardness of web portion (Hv) | Evaluation of fatigue damage property |
|---|---|---|---|---|
| 1 | 96 | 350 | 32 | B |
| 2 | 96 | 320 | 32 | B |
| 3 | 95 | 370 | 33 | B |
| 4 | 95 | 380 | 34 | B |
| 5 | 93 | 430 | 36 | C |
| 6 | 92 | 340 | 36 | C |
| 7 | 92 | 410 | 37 | C |
| 8 | 92 | 340 | 38 | C |
| 9 | 91 | 440 | 39 | C |
| 10 | 92 | 340 | 37 | C |
| 11 | 96 | 345 | 39 | C |
| 12 | 96 | 345 | 37 | C |
| 13 | 90 | 345 | 36 | C |
| 14 | 96 | 300 | 32 | C |
| 15 | 96 | 355 | 40 | C |
| 16 | 96 | 345 | 20 | S |
| 17 | 96 | 340 | 15 | S |
| 18 | 96 | 340 | 10 | S |
| 19 | 95 | 370 | 33 | B |
| 20 | 95 | 365 | 18 | S |
| 21 | 95 | 360 | 13 | S |
| 22 | 95 | 360 | 10 | S |
| 23 | 96 | 440 | 19 | S |
| 24 | 96 | 420 | 25 | A |
| 25 | 96 | 360 | 28 | A |
| 26 | 96 | 340 | 15 | S |
| 27 | 96 | 410 | 27 | A |
| 28 | 96 | 395 | 24 | A |
| 29 | 96 | 375 | 27 | A |
| 30 | 96 | 380 | 25 | A |
| 31 | 96 | 400 | 26 | A |
| 32 | 97 | 350 | 13 | S |
| 33 | 99 | 355 | 16 | S |
| 34 | 96 | 345 | 28 | A |
| 35 | 98 | 360 | 17 | S |
| 36 | 98 | 360 | 16 | S |
| 37 | 98 | 380 | 23 | A |

TABLE 4

| | Pearlite fraction of cross section of web portion (%) | Minimum value of cross-sectional hardness of web portion (Hv) | Difference between maximum value and minimum value of cross-sectional hardness of web portion (Hv) | Evaluation of fatigue damage property |
|---|---|---|---|---|
| A | 86 | 280 | 50 | X |
| B | 96 | 295 | 31 | X |
| C | 96 | 345 | 45 | X |
| D | 80 | 350 | 50 | X |
| E | 85 | 270 | 48 | X |

TABLE 4-continued

| | Pearlite fraction of cross section of web portion (%) | Minimum value of cross-sectional hardness of web portion (Hv) | Difference between maximum value and minimum value of cross-sectional hardness of web portion (Hv) | Evaluation of fatigue damage property |
|---|---|---|---|---|
| F | 75 | 480 | 70 | X |
| G | 85 | 320 | 55 | X |
| H | 78 | 460 | 85 | X |
| I | 85 | 285 | 50 | X |
| J | 96 | 370 | 48 | X |
| K | 96 | 345 | 45 | X |

As shown in Tables 1 to 4, the rails of the present invention (Invention Examples 1 to 37) were evaluated as rails that could suppress fatigue damage from occurring from the web portion and had excellent fatigue breakage resistance.

Specifically, in the rails of the present invention (Invention Examples 1 to 12), the C, Si, Mn, P, and S contents of steel were more favorably in the limited ranges, and the pearlite fraction in the cross section of the web portion, the minimum value of the cross-sectional hardness of the web portion, and the difference between the maximum value and the minimum value of the cross-sectional hardness of the web portion were further controlled as compared to the comparative rails (Comparative Examples D to K), so that the fatigue strength of the rail web portion was improved, and the fatigue damage resistance of the rail was improved.

Further, in the rails of the present invention (Invention Examples 13 to 22), as compared to the comparative rails (Comparative Examples A to C), hot rolling conditions and heat treatment conditions for the rail web portion were more appropriately controlled to control the pearlite fraction in the cross section of the web portion, the minimum value of the cross-sectional hardness of the web portion, and the difference between the maximum value and the minimum value of the cross-sectional hardness of the web portion, so that the fatigue strength of the rail web portion was improved, and the fatigue damage resistance of the rail was improved.

In addition, in the rails of the present invention (Invention Examples 16 to 18 and 20 to 22), controlled cooling conditions for the rail web portion were further appropriately controlled to further reduce the difference between the maximum value and the minimum value of the cross-sectional hardness of the web portion. As a result, the fatigue strength of the rail web portion was improved, and the fatigue damage resistance of the rail was even further improved.

On the other hand, in the rails in Comparative Examples A to K, one or more of the chemical composition, the metallographic structure in the cross section of the rail web portion, the minimum value of the hardness in the cross section of the rail web portion, and difference between the maximum value and the minimum value of the hardness in the cross section of the rail web portion were inappropriate, and the fatigue damage resistance was impaired.

INDUSTRIAL APPLICABILITY

According to the present invention, a rail can be provided in which the composition of rail steel and the metallographic structure of the rail web portion are controlled, and the minimum value of the hardness of the rail web portion and the difference between the maximum value and the minimum value of the hardness in the cross section thereof are suppressed, so that the strain concentration in the cross section of the rail web portion is suppressed, and the fatigue damage resistance required for the rail web portion used in a curved truck of freight railways is excellent.

BRIEF DESCRIPTION OF THE REFERENCE SYMBOLS

1: Rail web portion
2: Rail head portion
3: Rail foot portion

The invention claimed is:

1. A rail comprising steel composition including, by mass %:

C: 0.75 to 1.20%;
Si: 0.10 to 2.00%;
Mn: 0.10 to 2.00%;
Cr: 0 to 2.00%;
Mo: 0 to 0.50%;
Co: 0 to 1.00%;
B: 0 to 0.0050%;
Cu: 0 to 1.00%;
Ni: 0 to 1.00%;
V: 0 to 0.50%;
Nb: 0 to 0.050%;
Ti: 0 to 0.0500%;
Mg: 0 to 0.0200%;
Ca: 0 to 0.0200%;
REM: 0 to 0.0500%;
Zr: 0 to 0.0200%;
N: 0 to 0.0200%;
Al: 0 to 1.00%;
P: 0.0250% or less;
S: 0.0250% or less; and
a remainder including Fe and impurities, wherein 90 area % or greater of a metallographic structure in a cross section of a rail web portion is a pearlite structure, a minimum value of a hardness in the cross section of the rail web portion is Hv 300 or greater, and a difference between a maximum value and the minimum value of the hardness in the cross section of the rail web portion is Hv 40 or less.

2. The rail according to claim 1, wherein the difference between the maximum value and the minimum value of the hardness in the cross section of the rail web portion is Hv 20 or less.

3. The rail according to claim 2, wherein the steel composition includes, by mass %, one or two or more selected from the group consisting of:

Cr: 0.01 to 2.00%;
Mo: 0.01 to 0.50%;
Co: 0.01 to 1.00%;
B: 0.0001 to 0.0050%;
Cu: 0.01 to 1.00%;
Ni: 0.01 to 1.00%;
V: 0.005 to 0.50%;
Nb: 0.0010 to 0.050%;
Ti: 0.0030 to 0.0500%;
Mg: 0.0005 to 0.0200%;
Ca: 0.0005 to 0.0200%;
REM: 0.0005 to 0.0500%;
Zr: 0.0001 to 0.0200%;
N: 0.0060 to 0.0200%; and
Al: 0.0100 to 1.00%.

4. The rail according to claim 1, wherein the steel composition includes, by mass %, one or two or more selected from the group consisting of:

Cr: 0.01 to 2.00%;
Mo: 0.01 to 0.50%;
Co: 0.01 to 1.00%;
B: 0.0001 to 0.0050%;
Cu: 0.01 to 1.00%;
Ni: 0.01 to 1.00%;
V: 0.005 to 0.50%;
Nb: 0.0010 to 0.050%;
Ti: 0.0030 to 0.0500%;
Mg: 0.0005 to 0.0200%;
Ca: 0.0005 to 0.0200%;
REM: 0.0005 to 0.0500%;
Zr: 0.0001 to 0.0200%;
N: 0.0060 to 0.0200%; and
Al: 0.0100 to 1.00%.

5. The rail according to claim 1, wherein the rail includes a rail head portion, a rail foot portion, and the raid web portion extending between the rail head portion and the rail foot portion, and the web portion has a cross-sectional hardness distribution within a range of 0 to 40 Hv, the cross-sectional hardness distribution being a distribution of a hardness at a cross section in a thickness direction of the rail web portion that is perpendicular to a direction in which the web portion extends.

* * * * *